United States Patent [19]

Sauber

[11] 4,325,522

[45] Apr. 20, 1982

[54] REEL BRAKE CLAMPING ASSEMBLY

[76] Inventor: Charles J. Sauber, 10 N. Sauber Rd., Virgil, Ill. 60182

[21] Appl. No.: 201,252

[22] Filed: Oct. 27, 1980

[51] Int. Cl.[3] ..... B65H 59/04; B65H 75/40

[52] U.S. Cl. ..... 242/86.7; 188/72.9; 188/83; 242/156.2

[58] Field of Search ..... 242/156, 156.2, 86.5 R, 242/86.7, 99, 155 BW, 75.4; 188/72.9, 83; 74/491, 495, 498, 499, 500, 504, 507, 509, 552

[56] References Cited

U.S. PATENT DOCUMENTS

| | | | |
|---|---|---|---|
| 2,948,483 | 8/1960 | Petersen | 242/86.7 X |
| 3,000,587 | 9/1961 | Goode | 242/86.5 R |
| 3,000,588 | 9/1961 | Brady | 242/86.5 R |
| 3,073,574 | 1/1963 | Garnett | 242/86.5 R X |
| 3,367,600 | 2/1968 | Olson | 242/86.7 |
| 3,520,489 | 7/1970 | Flowers | 242/86.5 R |

*Primary Examiner*—Stanley N. Gilreath
*Attorney, Agent, or Firm*—Leydig, Voit, Osann, Mayer & Holt, Ltd.

[57] ABSTRACT

A cable reel support and brake clamping device such as may be used in connection with stringing power transmission lines, which includes a pair of spaced upright columns terminating in generally U-shaped ends, a reel support shaft having provision to fixedly receive the cable reel for rotation therewith bridges the column ends, and a brake device including spaced supporting members, a friction disc mounted on a shaft journalled to the supporting members and a pair of spaced brake clamping arms having brake shoe means at their ends facing the sides of the disc, the arms being carried by a shaft threaded at its inboard end to engage nut means and having a wheel at its outboard end adapted to move the brake arms toward one another upon rotation of the wheel in one direction and away from one another by spring means when rotated in the opposite direction wherein improved clamping means in the form of a pair of spaced dish shaped members having a resilient ring therebetween is disposed on the threaded shaft between the wheel and the outboard arm to provide more positive settings of "drag" and desired lock up in stringing operations.

4 Claims, 5 Drawing Figures

REEL BRAKE CLAMPING ASSEMBLY

FIELD OF THE INVENTION

The present invention relates generally to improvements in reel brakes of the type for a spool, carrying a cord or cable, journalled on a shaft which is mounted in a frame, with the brake device coupled to the shaft for controlling or stopping the unwinding of the cable or cord that is pulled from the spool.

More specifically, the present invention relates to a more positive clamping arrangement for operating a reel brake for a spool support assembly of the foregoing type having, as an improvement, a novel coupling both with respect to adjustable drag and lock setting capabilities for stringing cables. The present invention is an improvement over my prior Reel Brake Connection Apparatus disclosed in Sauber Application Ser. No. 721,035, filed Sept. 7, 1976, now abandoned.

BACKGROUND OF THE INVENTION

In cable reel assemblies such as described herein, the cable which may be used for a power transmission line that must be strung across poles may be carried to a work site on the bed of a truck. The cable spool is carried by a support structure which includes a brake device that may be set to either lock the spool to prevent unwinding of the cable or to set a predetermined amount of drag when the cable is being strung.

In my prior Application Ser. No. 721,035, now abandoned, there was disclosed a reel support and brake system for high tension cable stringing comprising, in general, a pair of spaced upright columns terminating in generally U-shaped ends which support a shaft adapted to receive the cable reel for rotation therewith and to bridge the column U-shaped ends. A brake device supported adjacent to one of the columns has a coupling member facing the U-shaped end of the column. The reel support shaft has a mutually engageable coupling member at its end directed to the brake device. The coupling members provide quick connection by way of a rib and slot arrangement adapted to slidably mate when the support shaft is vertically placed over the U-shaped column ends. In operation clamping devices may be placed in abutting relationship to the cable reel for the purpose of preventing the cable reel from sliding axially in an undesirable manner.

As indicated, in high tension wire stringing, wire discharged from a cable reel, at a desired and controlled rate, is strung across utility poles. During stringing it is important that proper adjustment of drag is obtainable to avoid flapping of the high tension wire as it is being discharged from the cable reel. Flapping of the wire being put up can result in contact with existing wire and even breakage thereof, possibly causing great harm to persons and property.

In addition, a positive brake setting must be maintained while loading and unloading of the cable reel or spool when the wire thereon has been expired.

The brake device as disclosed in my prior application was essentially a disc brake which included spaced supporting members, a friction disc mounted on a shaft journalled to the supporting members and a pair of spaced brake clamping arms having brake shoe means at their ends facing the sides of the disc, with the arms being carried by a threaded shaft having a wheel at its outboard end and adapted to move the brake arms toward and away from another upon rotation of the wheel. Insofar as the function and operation of the brake was concerned, it did provide for quicker, easier and safer cable stringing by virtue of the tension and control capabilities in the adjusting wheel that enabled setting up drag on the reel and obtaining the desired amount of sag in the cable as well as a positive lock up with ease of change over without disturbing the braking mechanism. However, there still was required a high degree of skill and experience by the operator to achieve the desired tensioning and drag set up in adjusting the hand wheel and ascertaining when sufficient tightening has occurred for lock up without over tightening engagement between metal parts of the wheel driven shaft and brake arm which are then difficult to loosen.

SUMMARY AND OBJECTS OF THE INVENTION

Accordingly, it is a primary object of the present invention to provide an improved brake clamping assembly for a cable reel brake of the type set forth wherein a more positive reaction feel is presented to the operator in setting the drag adjustments for controlling the play out of cable and a more certain and more definite feel is provided for the lock up setting that avoids overtightening and therefore an easier release of the lock setting.

Other objects and advantages of the invention will become apparent as the following description proceeds taken in connection with the accompanying drawings.

Figure 1:
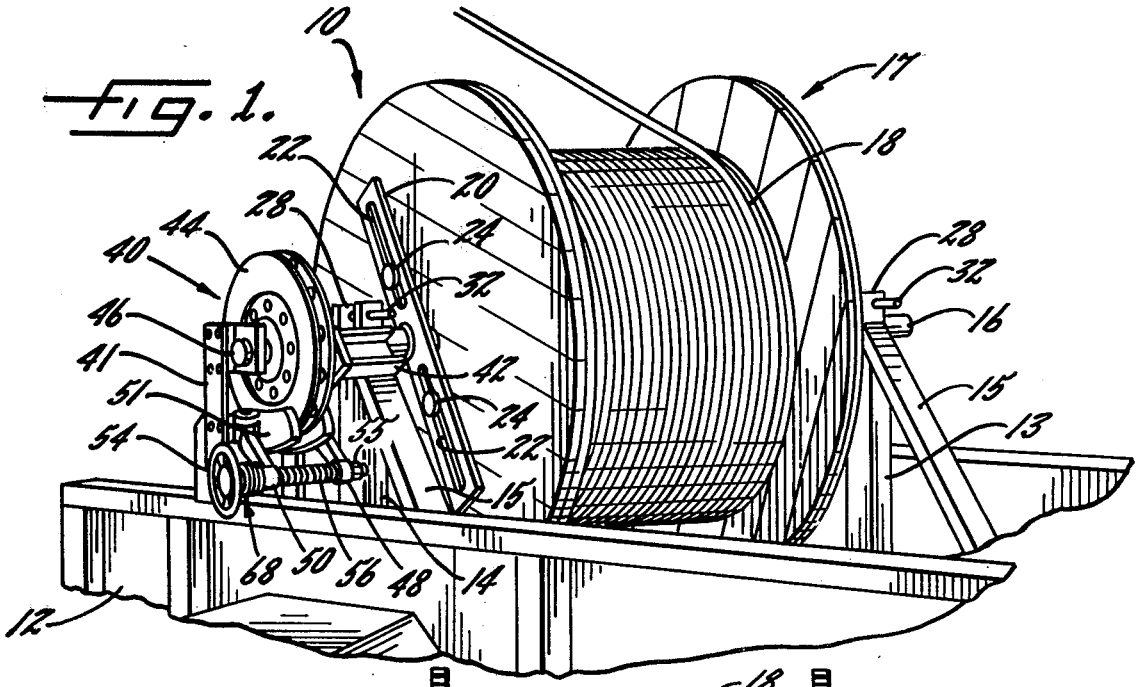
FIG. 1 is a perspective view of a cable reel and brake assembly which employs a brake coupling device in accordance with the present invention, the complete assembly here shown with reference to its being carried by a truck bed.

While a certain illustrative embodiment has been shown in the drawings and will be described below in considerable detail, it should be understood that there is no intention to limit the invention to the specific form disclosed. On the contrary, the intention is to cover all modifications, alternative constructions, equivalents and uses falling within the spirit and scope of the invention as defined by the appended claims.

DETAILED DESCRIPTION

Turning now to the drawings, the illustrative cable reel support and brake assembly, generally referred to at 10 which incorporates the brake clamping arrangement of the present invention is carried on the bed of a truck 12. This support comprises a pair of spaced upright columns 13, 14 which may have opposed angle braces 15, only two being shown, with the columns being adapted to receive outwardly projecting ends of a shaft 16 that passes through the central opening of a spool 17 carrying a coiled length of cable 18. This spool 17, is typically one including a cylindrical central drum having enlarged disc-like ends.

In order to mount the spool 17 on the shaft 16 to effect rotation as a unit and restrain the spool against axial movement, there is provided adjacent one side of the shaft, a fixed cross-bar 20 and the bar has a longitudinally extending slot 22 on each side of the shaft. Disposed in each slot is a slidable pin 24 that may adjustably engage socket openings provided in one end disc of the spool 17. An adjustable clamping collar 26 that may be slid over the shaft 16 adjacent the opposite side disc of the spool completes the connection of the spool with the shaft 16. Each of the upright columns 13, 14 terminates in a generally U-shaped opening, so that the projecting ends of the shaft 16 supporting a spool carrying the cord may be simply placed over and bridged between the support columns. Aligned holes in the sides defining the column opening 28 receive a cross pin 32 so that the shaft 16 is vertically restrained with respect to the support columns.

Figure 2:
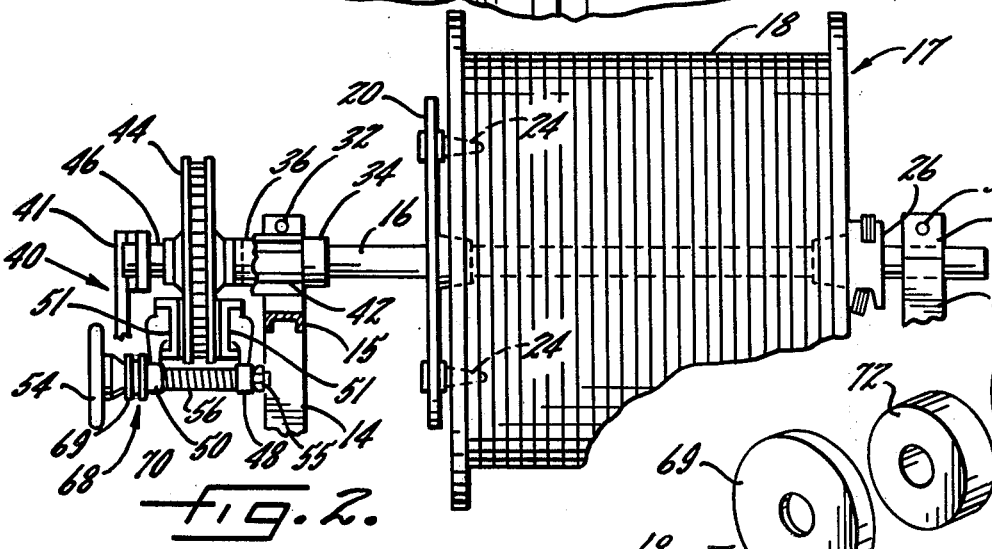
FIG. 2 is a vertical elevation view of the cable reel brake and support arrangement of FIG. 1 showing only the fragmentary upper portion of the support frame.
Figure 3:
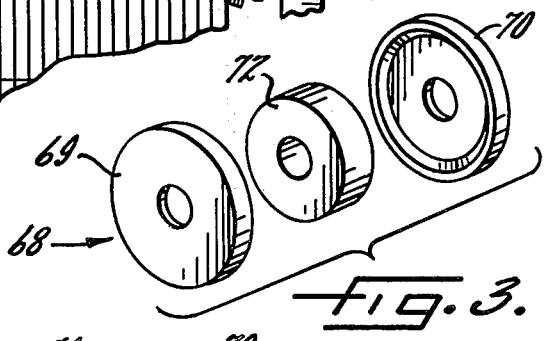
FIG. 3 is an enlarged, fragmentary exploded perspective view of the brake clamping assembly according to the present invention.

In order to retain the shaft 16 against axial movement, a pair of spaced enlarged diameter portions 34, 36 (FIG. 2) straddle the column 14 and when the part of the shaft 16 between the enlarged diameter portions is seated within the U-shaped opening 28, the shaft supporting the cord spool is constrained axially.

In order to provide for wire discharge from a cable reel at a desired and controlled rate which is the drag adjustment and to positively lock the cable reel in a fixed position such as for loading and unloading, a manually operated braking device, generally indicated at 40, is mounted to an upright support member 41 and a bracket 42, the latter being fixed to a brace 15 of column 14. The braking device includes a friction disc member 44 held by a shaft 46 which is journalled for rotation between the support member 41 and the brace 42. A pair of clamping arms 48, 50 include brake shoe members 51 disposed parallel to the opposite faces of the friction disc 44. The clamping arms 48, 50 are carried by a shaft 52 which may be rotated by a wheel member 54. The inboard end of the shaft is threaded and carries nut means 55. A spring 56 is disposed between the arms 48, 50.

The arrangement is such that the arm 48 and arm 50 move toward one another against the spring when the shaft 52 is rotated via wheel 54 in one direction by the threaded shaft end being pulled through the nut means and the arms move away from one another when the wheel is turned in the opposite direction by action of the spring when the threaded end of the shaft moves out of the nut means. Thus, it will be appreciated that the clamping pressure through the arms and brake shoes 51 against the friction disc may be set to fully brake or restrain the disc against rotation or a predetermined amount of drag may be set as well as releasing all clamping pressure so that the disc may rotate freely.

In accordance with the principal aspect of the present invention, an improved resilient clamping means is provided in association with the manual wheel and threaded shaft operating the clamping arms of the braking device such that a more positive, increasing reaction feel is directed back to the operator while making the predetermined amount of drag settings and positively indicating when the lock up position is achieved to avoid overtightening and easy release of the brake. To this end, the resilient coupling means, generally indicated at 68, is interposed on the threaded shaft 52 between the wheel 54 and outboard arm 50 so that rotation of the wheel in the direction causing the brake shoe members to bear against the disc 44 first squeezes the resilient coupling device with the reaction feel being obtained by the continual compression of a resilient element and then there is a metal-to-metal contact between the rigid elements of the coupling device that occurs upon lock up of the brake shoes against the disc 44.

Figure 4:
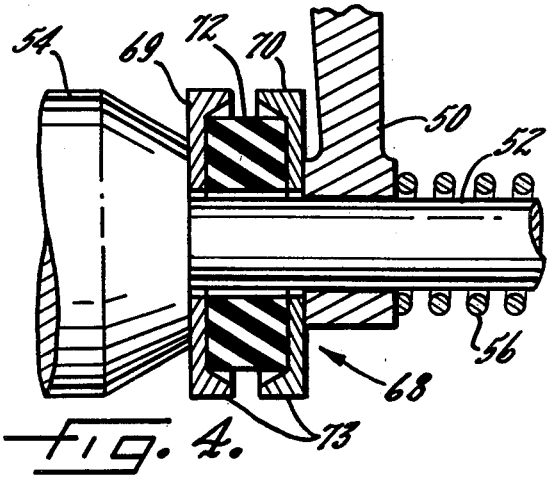
FIG. 4 is an enlarged, fragmentary sectional view of the brake clamping assembly portion of the brake in FIG. 2 showing the uncompressed position of the clamping assembly.
Figure 5:
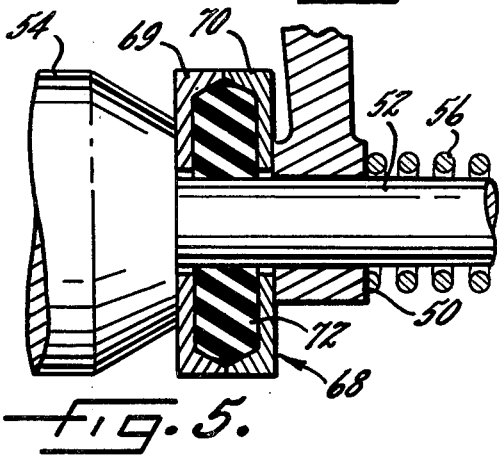
FIG. 5 is a view similar to FIG. 4, but here showing the fully compressed position of the clamping assembly.

As best shown in FIG. 4, the coupling device comprises a pair of dish shaped metal members 69, 70 normally spaced from one another by a resilient ring 72. The resilient ring 72 is wider than the combined axial depth of the peripheral rims 73 of the dish shaped members 69, 70 and the ring 72 is smaller in diameter than the inner diameter of the rims. Thus, as the dish shaped members are compressed together the resilient ring which is also compressed can expand and fill in yet remain confined within the peripheral rims until they are brought tightly into contact with one another.

The resilient ring 72, which is preferably made of a solid rubbery material, provides a sufficient progressively increasing reaction to the compressive force applied to enable the operator to more definitely and reliably achieve desired drag settings. Also, there is a definitive and positive feel at the transition when the rims of the dish shaped members come together. Consequently, over tightening which could otherwise stress the brake shoe arms is avoided and the loosening is much easier.

I claim as my invention:

1. In a cable reel support and brake device such as may be used in connection with stringing power transmission lines, the combination comprising, spaced upright column means, a reel support shaft having provision to fixedly receive a cable reel for rotation therewith bridging the column ends, brake device means mounted on spaced supporting members, a friction disc mounted on a shaft that is journalled to said supporting members and removably coupled to the reel support shaft, a pair of spaced brake clamping arms having brake shoe means at their ends facing the sides of the disc, said arms being carried by a shaft means having a wheel at its outboard end and a threaded end engaging nut means at its inboard end, spring means carried by said shaft between the said arms, said wheel adapted to move the arms toward one another upon rotation in one direction and the spring means moves the arms away from one another when rotated in the opposite direction, clamping means carried by said shaft and comprising a pair of spaced dish shaped members having a resilient ring member therebetween, and said clamping means being disposed such that rotation of said wheel in the direction that moves the brake shoe means at the ends of the clamping arms into engagement with the sides of the friction disc urges said spaced dish shaped members toward one another and compresses the resilient ring thereby providing positive settings of "drag" on said cable reel through the friction brake device.

2. A cable reel support and brake device as claimed in claim 1 wherein "lock up" of the cable reel by said brake device is associated with the full compression of said resilient ring between the dish shaped members coming into rigid engagement with one another.

3. A cable reel support and brake device as claimed in claim 2 wherein said resilient ring in an uncompressed state is wider than the combined axial depths of peripheral rims of said dish shaped members and the ring is smaller in diameter than the inner diameter of the dish shaped member rings so that when the dish shaped members are compressed together the resilient ring may be compressed to expand and fill in while remaining confined within the peripheral rims that can be brought tightly into contact with one another.

4. A cable reel and brake device as claimed in claim 3 wherein said resilient ring is made of a solid rubbery material.

* * * * *